US005724048A

United States Patent [19]

Remondiere

[11] Patent Number: 5,724,048

[45] Date of Patent: Mar. 3, 1998

[54] ARRAY ANTENNA, IN PARTICULAR FOR SPACE APPLICATIONS

[75] Inventor: Olivier Remondiere, Frouzins, France

[73] Assignee: Alcatel, N.V., Amsterdam, Netherlands

[21] Appl. No.: 828,012

[22] Filed: Jan. 30, 1992

[30] Foreign Application Priority Data

Feb. 1, 1991 [FR] France ..... 91 01153

[51] Int. Cl.[6] ..... H01Q 1/38

[52] U.S. Cl. ..... 343/700 MS; 343/769

[58] Field of Search ..... 343/700 MS, 778, 343/767, 770, 787, 769; H01Q 1/38

[56] References Cited

U.S. PATENT DOCUMENTS

| | | | |
|---|---|---|---|
| 4,208,660 | 6/1980 | McOwen | 343/769 |
| 4,527,165 | 7/1985 | deRonde | 343/778 |
| 4,829,309 | 5/1989 | Tsukamoto et al. | 343/700 MS |
| 4,857,938 | 8/1989 | Tsukamoto et al. | 343/700 MS |
| 4,987,425 | 1/1991 | Zahn et al. | 343/700 MS |
| 5,030,961 | 7/1991 | Tsao | 343/700 MS |
| 5,086,304 | 2/1992 | Collins | 343/778 |

OTHER PUBLICATIONS

Mailloux et al, "Microstrip Array Technology", IEEE Trans. on Antennas and Prop., vol. AP-29, No. 1, Jan. 1981, pp. 25–37.

Haneishi et al, "A New Circularly Polarised Planar Antenna Fed by Electromagnetical Coupling and its Subarray", *18th European Microwave Conf. 88 (Stockholm)*, Sep. 88, pp. 1074–1078.

Patent Abstracts, vol. 9, No. 123 (E-317) (1846), May 28, 1985, of Japan, 60–10805(A) and 60–10806(A).

R. Andrewartha, et al., "Advanced Sar Design For . . . ", 10th Int'l. Geoscience & Remote Sensing Symp. Igarss, V 3, May 1990 pp. 2473–2476.

R. Vidano, et al., "Packaging a Microwave Antenna . . . ", Electronic Packaging and Production, vol. 29, No. 12, Dec. 1989, Newton, Mass., pp. 52–55.

*Primary Examiner*—Michael C. Wimer

*Attorney, Agent, or Firm*—Robbins, Berliner & Carson, LLP

[57] ABSTRACT

An array antenna in particular for space applications comprises radiating elements having a stratified type of structure. These elements are fixed on a support structure having openings beneath the radiating elements.

11 Claims, 3 Drawing Sheets

PRIOR ART

ARRAY ANTENNA, IN PARTICULAR FOR SPACE APPLICATIONS

The invention relates to an array antenna, in particular for space applications.

BACKGROUND OF THE INVENTION

An array antenna has the feature of presenting an aperture constituted by a large number of radiating elements. The radiation from the antenna is thus synthesized by the radiation from each radiating element. The development of such antennas is recent, and applications are being found for them in fields as varied as:

air traffic control;

satellite reception (television, message transmission, communication with mobiles); and space antennas: remote detection and observation of the Earth (radars), data relays, telecommunications antennas.

The frequencies covered go from VHF and UHF waves to millimetric waves. When the radiating elements are controlled individually in amplitude and/or phase, the antenna is said to be "active": the shape of the radiation pattern of the antenna can be selected in such a manner as to obtain, for example, very different types of coverage areas (narrow beam, wide beam, or shaped beam), or to perform electronic scanning.

The radiating elements constituting the antenna condition performance, technical characteristics (mass, ability to withstand the environment, reliability), and cost of the antenna by means of their intrinsic radio performance, their capacity to be interconnected in an array, and the technology used to make them.

Since an antenna is made up of several tens to several thousands of such radiating elements, the unit cost of the elements is a determining factor in the overall cost of the antenna. The same type of reasoning applies to other parameters such as mass. The choice of technology is important since it makes it possible to simplify problems of matching the antenna to its environment. For example, for space applications in geostationary orbit, it is important to be able to control antenna temperature by means that are simple (thermal coverings, paint) without calling for heater power which would spoil the energy budget of the system. Under such conditions, temperature ranges as great as −150° C. to +120° C. may arise, given the thermo-optical characteristics of the surfaces. In addition, such an antenna is subjected to fluxes of charged particles that must neither damage the materials nor give rise to electrostatic discharges after accumulating on insulating areas or on areas that are poorly grounded.

An antenna must retain all of its radio qualities even after being subjected to high mechanical stresses during launching.

To make up an array, the radiating elements must be connected to a support structure by an interface device. These two items, the support structure and the interface must be optimized in mass, taking account of their performance in stiffness and in mechanical strength as required for launching, and also their performance in stiffness and in dimensional stability as required for radio purposes once the satellite is in orbit. Present solutions make it possible to achieve masses per unit area of about 4.5 kg/m$^2$ to 7 kg/m$^2$.

An object of the invention is to solve these problems.

SUMMARY OF THE INVENTION

To this end, the invention provides an array antenna for space applications constituted by radiating elements having a stratified type of structure and wherein said elements are fixed to a support structure having openings beneath the radiating elements.

In an advantageous embodiment, the array antenna comprises at least one subarray made up of four radiating elements; each radiating element being constituted by a slot formed between a central disk and an upper ground plane, a transmission line situated at a lower level feeding said slot; each subarray comprising a plurality of different layers:

a conductive lower ground plane;

a dielectric adhesive layer;

a first dielectric spacer on which a conductive track is disposed which is split into four transmission lines each feeding one of the radiating elements;

a second dielectric spacer;

a dielectric adhesion layer; and an upper conductive ground plane.

The invention makes it possible to obtain radiating panels for an array antenna of very low mass per unit area.

The invention proposed has technical and economic qualities that are particularly appropriate for space applications, although small modifications would not prevent it from being used in possible applications in other fields.

BRIEF DESCRIPTION OF THE DRAWINGS

Embodiments of the invention are described by way of example with reference to the accompanying drawings, in which.

DETAILED DESCRIPTION

Figure 1:
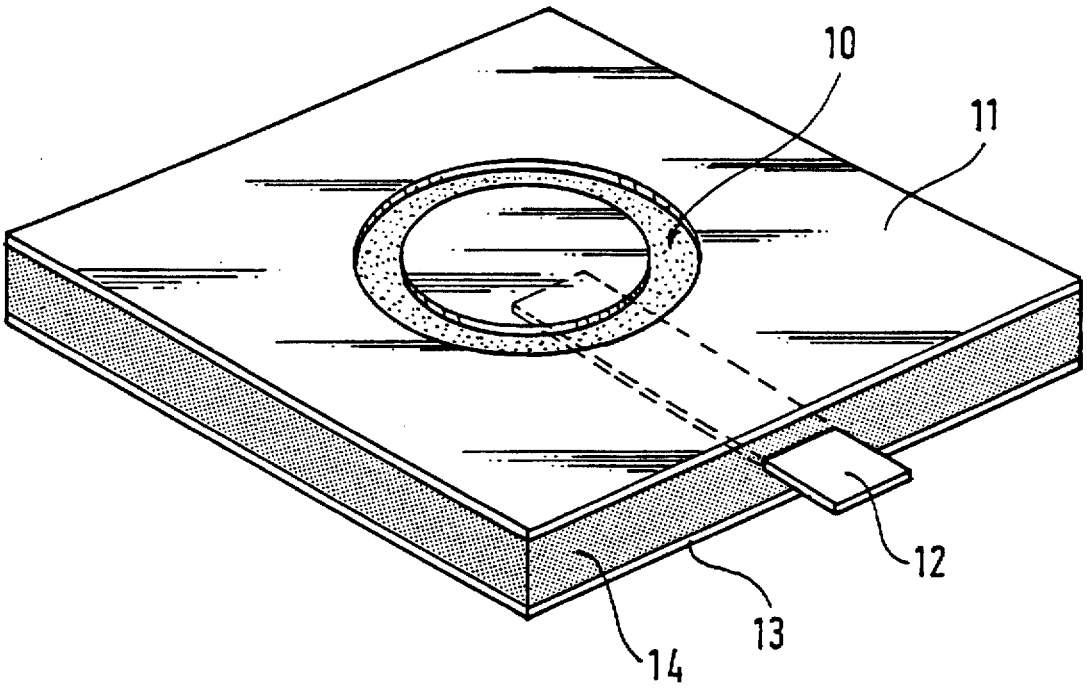
FIG. 1 shows a prior art device.

The radiating element as shown in FIG. 1 is commonly called an annular slot. Such an element is described in the article entitled "A new circularly polarized planar antenna fed by electromagnetical coupling and its subarray" by M. Haneishi, Y. Hakura, S. Saito and T. Hasegawa ("18th European Microwave Conference Proceedings" 12–15 Sep. 1988; Stockholm). In such a radiating element, a slot 10 is formed in a first ground plane 11. It is fed by electromagnetic coupling from a propagation line 12 of the stripline type situated at a lower level between the first ground plane 11 and a second ground plane 13. The stripline 12 is held in place by a dielectric 14.

Figure 2:
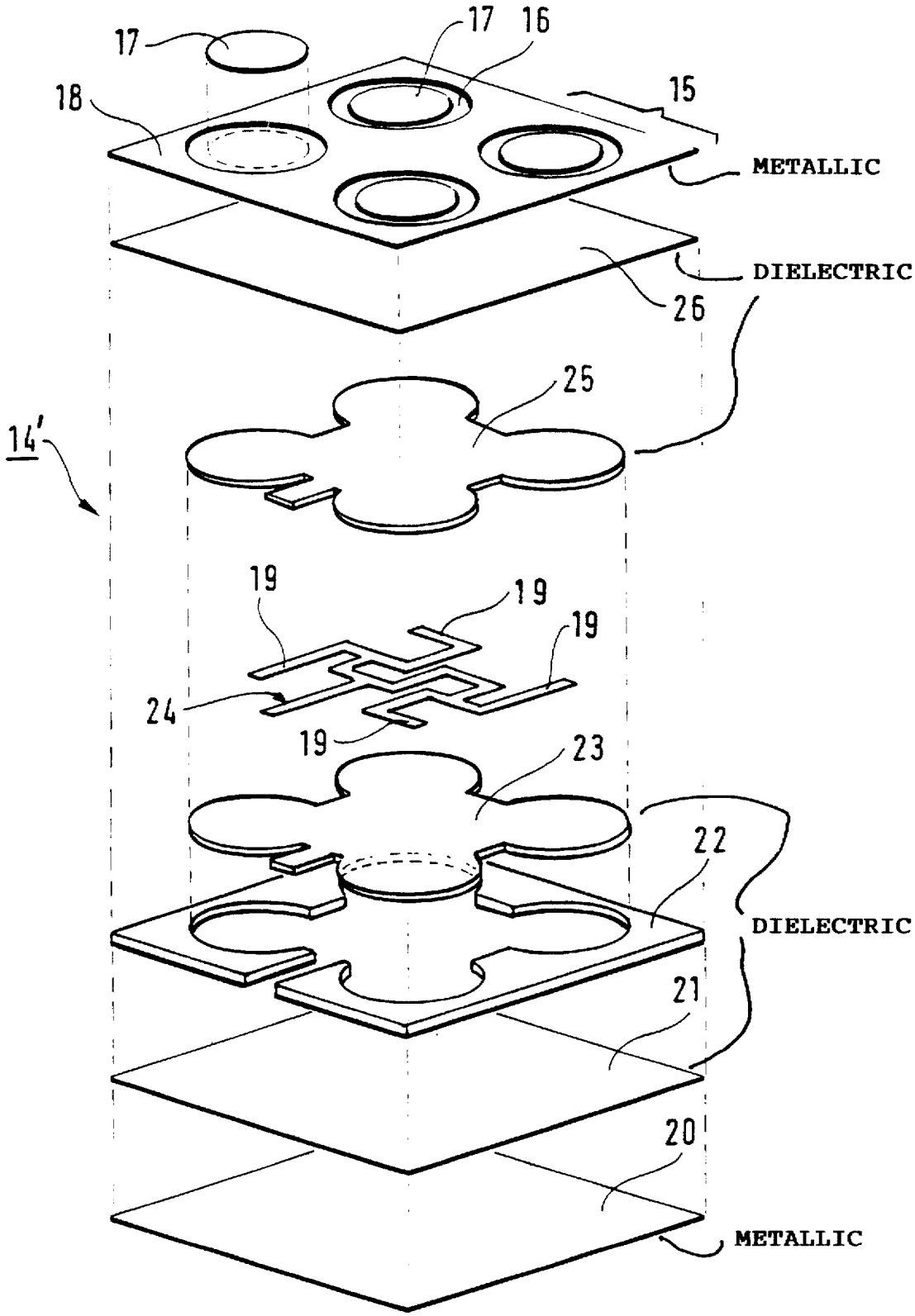
FIGS. 2 and 3 show the device of the invention.
Figure 3:
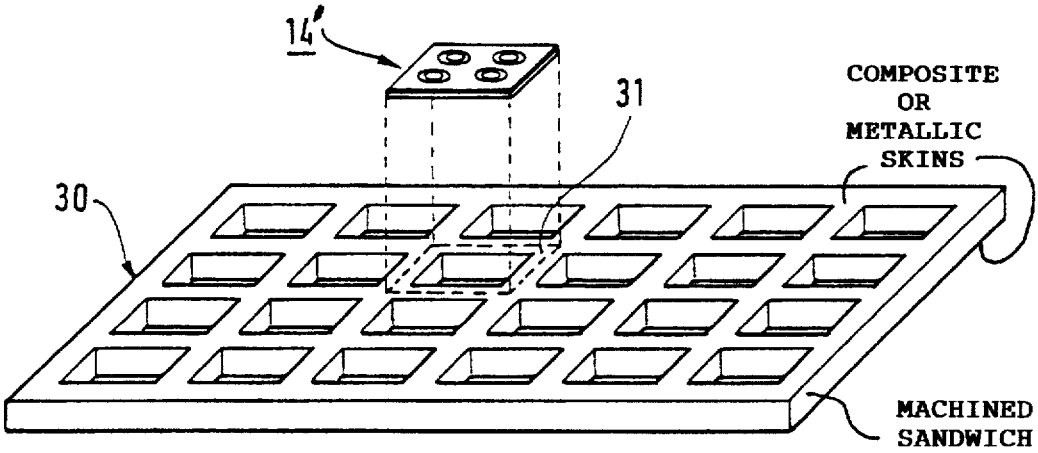

The subarray 14' shown in FIGS. 2 and 3 has four radiating elements 15. Each radiating element 15 comprises an annular slot 16 formed between a central disk 17 (or "patch") and an upper ground plane 18, with a transmission line 19 situated at a lower level feeding said slot 16.

This subarray thus comprises various different layers:

a lower ground plane 20 (conductive);

an dielectric adhesion layer 21;

a conductive spacer 22 if necessary from the mechanical point of view;

a first dielectric spacer 23 on which a conductive track 24 is disposed which splits up into four transmission lines 19 each feeding one of the radiating elements;

a second dielectric spacer 25;

an dielectric adhesion layer 26; and the top (conductive) ground plane 18.

The subarray 14' made up of a stack of conductive and insulating layers whose masses are minimized while still ensuring that the minimum mechanical characteristics of the subarray suffice for ensuring good operation. Thus, the ground planes are constituted by respective metal foils or metallized dielectric layers. The materials constituting the ground planes of the subarrays are selected in such a manner as to obtain the minimum mechanical characteristics necessary for proper operation for as little mass as possible.

The spacing between the ground planes is given by materials having very low density: foam materials or honeycomb materials (i.e. materials having a cellular structure). These materials may be dielectric or conductive depending on whether they are placed at locations where the electromagnetic field is intense or not. Such components are assembled together by adhesive to constitute a stratified sandwich-type structure.

Several subarrays may be integrated in a single continuous sandwich without changing the invention.

These subarrays whose mass has been minimized in this way are fixed to a support structure 30 which is also optimized. As shown in FIG. 3, the support structure 30 has openings so as to provide interface zones 31 for receiving the peripheries of the subarrays.

Figure 4:
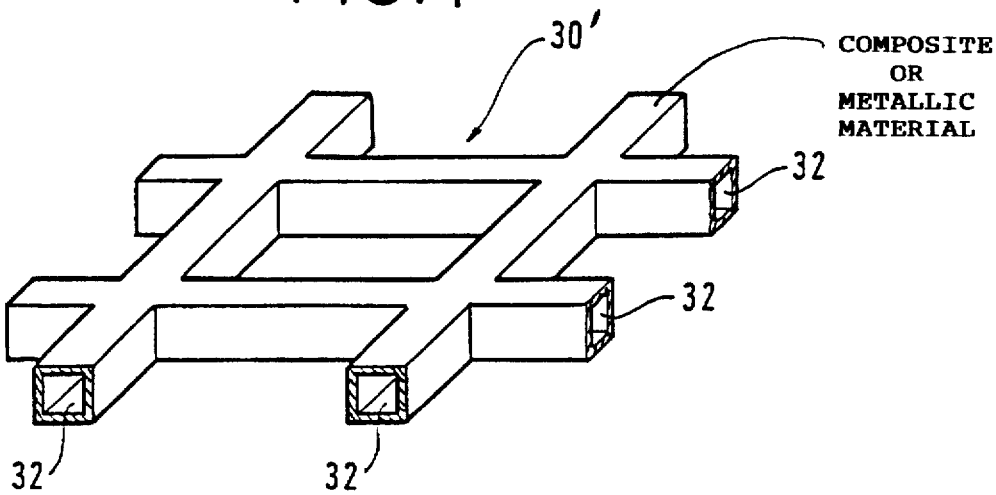
FIG. 4 shows a variant of the device of the invention.

The support structures 30 which provides good mechanical behavior to the antenna assembly is advantageously made by using materials having high mechanical performance such as carbon-reinforced composites, beryllium, or light alloys, and taking account of mechanical and economic constraints. The structure 30 may be obtained from a "sandwich" plate having the same dimensions as the antenna and having openings provided by machining. This solution simplifies problems at the nodes of the structure. However, other solutions may be mentioned such as assembling shaped tubes 32 into a support structure 30' as shown in FIG. 4.

Since the subarrays are fastened to the support structure 30 by gluing around their peripheries 31, it is advantageous to interpose a flexible layer such as honeycomb or foam between the subarrays and the support structure to enhance thermoelastic decoupling.

In one embodiment of the antenna, constituting a space antenna for communication with mobiles in band L, the antenna comprises a plane 2.1 m×2.1 m panel (m=meter) fixed at six points to a satellite platform. It is made up of 36 subarrays each having four radiating annular slots 16 and each including a coaxial access. Each subarray is made up of a glued assembly of very thin foils of aluminum alloy constituting the ground planes together with an aluminum honeycomb in zones that do not have radio functions. In zones having radio functions, the aluminum honeycomb is replaced by a dielectric honeycomb that supports a copper track enabling TEM propagation to be obtained from the coaxial access to feed the four radiating elements by electromagnetic coupling. The thickness of the aluminum foils is designed so as to obtain stiffness and mechanical strength that are no greater than necessary.

The support structure 30 is obtained by machining a sandwich plate having skins made of ultra high modulus carbon fiber (i.e. very stiff carbon fiber) and an epoxy matrix glued onto an aluminum honeycomb. The thickness of the skins is minimized so as to obtain mechanical characteristics that are no greater than those required for withstanding the launch environment. The subarrays are assembled to the support structure by being glued thereto via respective honeycomb layers.

Since these technologies can withstand large temperature variations, simple thermal control is used: white paint on the front face of the antenna is applied to the subarrays and a tensioned multi-layer of superinsulation is disposed over the rear face of the support structure.

When these various items and the coaxial feed cables are taken into account in the mechanical dimensioning, it is possible to obtain a total mass per unit area (excluding the coaxial cables) of less than 3 kg/m$^2$.

By using even higher-performance materials such as beryllium, metal matrix composites, and UHM carbon fiber composites having organic matrices used in plies of small thickness (less than or equal to 25 μm), it is possible to envisage obtaining a total mass per unit area (ignoring coaxial cables) of about 2.3 kg/m$^2$.

Naturally, the present invention has been described and shown merely by way of preferred example and its component parts could be replaced by equivalent parts without thereby going beyond the scope of the invention.

I claim:

1. An array antenna for space applications, the antenna comprising:

a plurality of subarrays each containing at least four radiating elements inside a respective common periphery, each said subarray being in the form of a physically separate stack of conductive and dielectric layers bounded by said respective common periphery; and a support structure having a plurality of openings arranged in a two dimensional array, each said opening being a respective common opening located beneath a major portion of all of said at least four radiating elements of a respective said subarray and each said opening being surrounded by an interface zone defining a support surface for fixing to said common periphery of the respective subarray.

2. An array antenna according to claim 1, wherein each radiating element is constituted by a slot situated at an upper level of said stack and extending between a respective conductive central disk and a common upper ground plane, and a transmission line is situated at a lower level of said stack for feeding said slot.

3. An antenna according to claim 1, wherein said plurality of conductive and dielectric layers comprises:

a conductive lower ground plane;

a dielectric adhesive layer;

a first dielectric spacer on which a conductive track is disposed which is split into four transmission lines each feeding one of the radiating elements;

a second dielectric spacer;

a dielectric adhesion layer; and an upper conductive layer comprising at least four central disks and a common upper ground plane.

4. An antenna according to claim 3, wherein the conductive layers are metallic layers selected from the group consisting of metal layers, metal-plated dielectric layers, and composite layers having metal matrices.

5. An antenna according to claim 3, wherein the subarrays are glued to the support structure only at their respective peripheries.

6. An array antenna according to claim 1, wherein the support structure is made from a sandwich plate into which said openings are defined.

7. An array antenna according to claim 6, wherein the sandwich plate includes skins of a composite material comprising carbon reinforcement and a matrix that is selected from the group consisting of organic and metallic materials.

8. An array antenna according to claim 6, wherein the sandwich plate has metal skins.

9. An array antenna according to claim 1, wherein the support structure comprises an assembly of shaped tubes.

10. An array antenna according to claim 9, wherein the shaped tubes are made of composite materials comprising carbon reinforcement and a matrix that is selected from the group consisting of organic and metallic materials.

11. An array antenna according to claim 9, wherein the shaped tubes are made of a metallic material selected from the group consisting of metal and metal alloy.

* * * * *